US006575667B1

(12) United States Patent
Burt et al.

(10) Patent No.: US 6,575,667 B1
(45) Date of Patent: Jun. 10, 2003

(54) SEAWALL PANEL

(75) Inventors: Kevin T. Burt, Columbus, OH (US); Miguel Terc, Atlanta, GA (US)

(73) Assignee: CMI Limited Co., Atlanta, GA (US)

( * ) Notice: Subject to any disclaimer, the term of this patent is extended or adjusted under 35 U.S.C. 154(b) by 0 days.

(21) Appl. No.: 09/199,933

(22) Filed: Nov. 25, 1998

(65) Prior Publication Data

(65)

(Under 37 CFR 1.47)

Related U.S. Application Data

(60) Provisional application No. 60/066,588, filed on Nov. 26, 1997.

(51) Int. Cl.[7] ..... E02D 5/08

(52) U.S. Cl. ..... 405/287; 405/274; 405/284

(58) Field of Search ..... 405/274, 276, 405/277, 278, 279, 280, 281, 285, 284

(56) References Cited

U.S. PATENT DOCUMENTS

| | | | | | |
|---|---|---|---|---|---|
| 1,066,822 | A | * | 7/1913 | Lamp | 405/281 |
| 1,197,374 | A | * | 9/1916 | Hobbs | 405/281 |
| 1,722,674 | A | * | 7/1929 | Oberschulte | 405/281 |
| 1,884,686 | A | * | 10/1932 | Hilpert | 405/281 |
| 4,674,921 | A | | 6/1987 | Berger | 405/262 |
| 4,863,315 | A | * | 9/1989 | Wickberg | 405/274 |
| 5,125,765 | A | | 6/1992 | Verble | 405/31 |
| 5,145,287 | A | | 9/1992 | Hooper et al. | 405/242 |
| 5,292,208 | A | * | 3/1994 | Berger | 405/281 |
| 5,333,971 | A | * | 8/1994 | Lewis | 405/274 |
| 5,447,393 | A | * | 9/1995 | Yeates | 405/274 |
| 5,468,098 | A | | 11/1995 | Babcock | 405/262 |
| 5,580,191 | A | | 12/1996 | Egan | 405/262 |
| 6,000,883 | A | * | 12/1999 | Irvine et al. | 405/281 |
| 6,033,155 | A | * | 3/2000 | Irvine et al. | 405/274 |

* cited by examiner

*Primary Examiner*—Frederick L. Lagman
(74) *Attorney, Agent, or Firm*—Standley & Gilcrest LLP

(57) ABSTRACT

The present invention is directed to a retaining panel of one-piece construction for a body of water. A preferred embodiment of the retaining panel comprises a central portion, two side portions, and two flanges. The central portion has a first end and a second end. One side portion is integrally connected to and extends at a first angle from the first end of the central portion. Similarly, the other side portion is integrally connected to and extends at a second angle from the second end of the central portion. It is preferred that the first angle and the second angle are approximately equal. It is further preferred that the lengths of the first and second side portions are approximately equal. One flange is integrally connected to and extends at a third angle from a rear end of one side portion, and the other flange is integrally connected to and extends at a fourth angle from a rear end of the other side portion. It is preferred that the third and fourth angles are approximately equal. Each of the flanges has a proximal portion and a distal portion. The distal portion of one of the flanges defines a female connecting portion, and the distal portion of the other flange defines a male connecting portion. The retaining panel is preferably adapted to be interlocked with a substantially similar, adjacent retaining panel by inserting its male connecting portion into the female connecting portion of the adjacent retaining panel.

23 Claims, 9 Drawing Sheets

SEAWALL PANEL

This application claims the benefit of U.S. Provisional Application No. 60/066,588, filed Nov. 26, 1997.

BACKGROUND AND SUMMARY OF THE INVENTION

The present invention relates generally to a retaining panel for a body of water and, more particularly, to a retaining panel that may protect against a bounding shore with its top preferably extending above ground level and its bottom preferably anchored down into the ground below the water bottom. A preferred embodiment of a retaining panel of the present invention may be adapted for use as a seawall, a ground erosion barrier, a barrier against land erosion caused by waterways such as rivers, streams, ponds, lakes, seas, and oceans, a shoreline bulkhead, a wave breaker, a retaining wall, a footbridge, or as a panel in a wall structure for any other suitable use. A retaining panel of the present invention may be made from a variety of materials using a variety of techniques which will become apparent to one of ordinary skill in the art upon reading this disclosure. For example, a retaining panel of the present invention may comprised of extruded plastic or other similar material.

Over the years, there has existed the problem of land erosion caused by waterways such as rivers, streams, ponds, lakes, seas, and oceans. In order to limit and/or prevent the land erosion, efforts have been made to provide a series of seawall panels that are laterally aligned, interconnected, and anchored into the ground so as to provide a barrier against a waterway. The seawall panels may be subjected to enormous pressures and loads which may ultimately break the connection between adjacent seawall panels. Consequently, the barrier may become less effective over time, and individual seawall panels may have to be repaired or replaced. This may be expensive, and it may require the use of special heavy construction equipment.

In light of the costs of repairing barriers made from seawall panels, a need exists for seawall panels that are better adapted to endure various pressures and loads. Another need exists for minimizing the pressures and loads that are applied on the joints between adjacent seawall panels. There is also a need for minimizing the number of seawall panels required to make a barrier so that there are fewer joints that are subjected to various pressures and loads. Still another need exists for providing seawall panels that are easier to install and replace.

The present invention satisfies some or all of these needs. A preferred embodiment of the retaining panel comprises a central portion, two side portions, and two flanges. It is preferred that the retaining panel is of one-piece construction. The central portion has a first end and a second end. The first side portion is integrally connected to and extends rearwardly at a first angle from the first end of the central portion. Similarly, the second side portion is integrally connected to and extends rearwardly at a second angle from the second end of the central portion. The first flange is integrally connected to and extends from a rear end of the first side portion, and the second flange is integrally connected to and extends from a rear end of the second side portion. Each of the flanges has a proximal portion and a distal portion. The distal portion of the first flange defines a female connecting portion, and the distal portion of the second flange defines a male connecting portion. As a result, the retaining panel is preferably adapted to be connected to a substantially similar, adjacent retaining panel by inserting its male connecting portion into the female connecting portion of the adjacent retaining panel. It is further preferred that the retaining panel is adapted to be interlocked with the adjacent retaining panel by inserting the male connecting portion of the retaining panel into the female connecting portion of the adjacent retaining panel.

It is preferred that the first angle and the second angle are approximately equal. It is further preferred that the lengths of the first and second side portions are approximately equal. The first flange may extend from the first side portion at a third angle, and the second flange may extend from the second side portion at a fourth angle. The third and fourth angles are preferably about equal. It is preferred that the central portion is approximately parallel to the proximal portions of the first flange and the second flange.

A preferred embodiment of a retaining panel of the present invention may have a substantially uniform thickness. It should be recognized, however, that the thickness of a retaining panel of the present invention may vary. It is also preferred that an intermediate portion of the central portion has a substantially level outer surface approximately between the first end and the second end. Similarly, an intermediate portion of the first side portion may have a substantially level outer surface approximately between the first end of the central portion and the rear end of the first side portion, and an intermediate portion of the second side portion may have a substantially level outer surface approximately between the second end of the central portion and the rear end of the second side portion. Moreover, the proximal portion of the first flange may have a substantially level outer surface approximately between the rear end of the first side portion and the distal portion of the first flange, and the proximal portion of the second flange may have a substantially level outer surface approximately between the rear end of the second side portion and the distal portion of the second flange.

A retaining panel of the present invention may be made from a variety of materials. For example, a retaining panel of the present invention may be made from plastic, wood, steel, other sufficiently rigid materials, or combinations of these materials. A preferred embodiment of a retaining panel of the present invention is comprised of a plastic material such as polyvinyl chloride (PVC). A plastic material preferably prevents and/or withstands heat, cold, pressure exerted by the water, pressure exerted by the land, corrosion, and sunlight. A plastic material also preferably makes a retaining panel of the present invention relatively lightweight, easy to install, and easy to repair or replace. In addition, conventional extrusion or molding processes may be utilized to make a retaining panel of the present invention from a plastic material.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
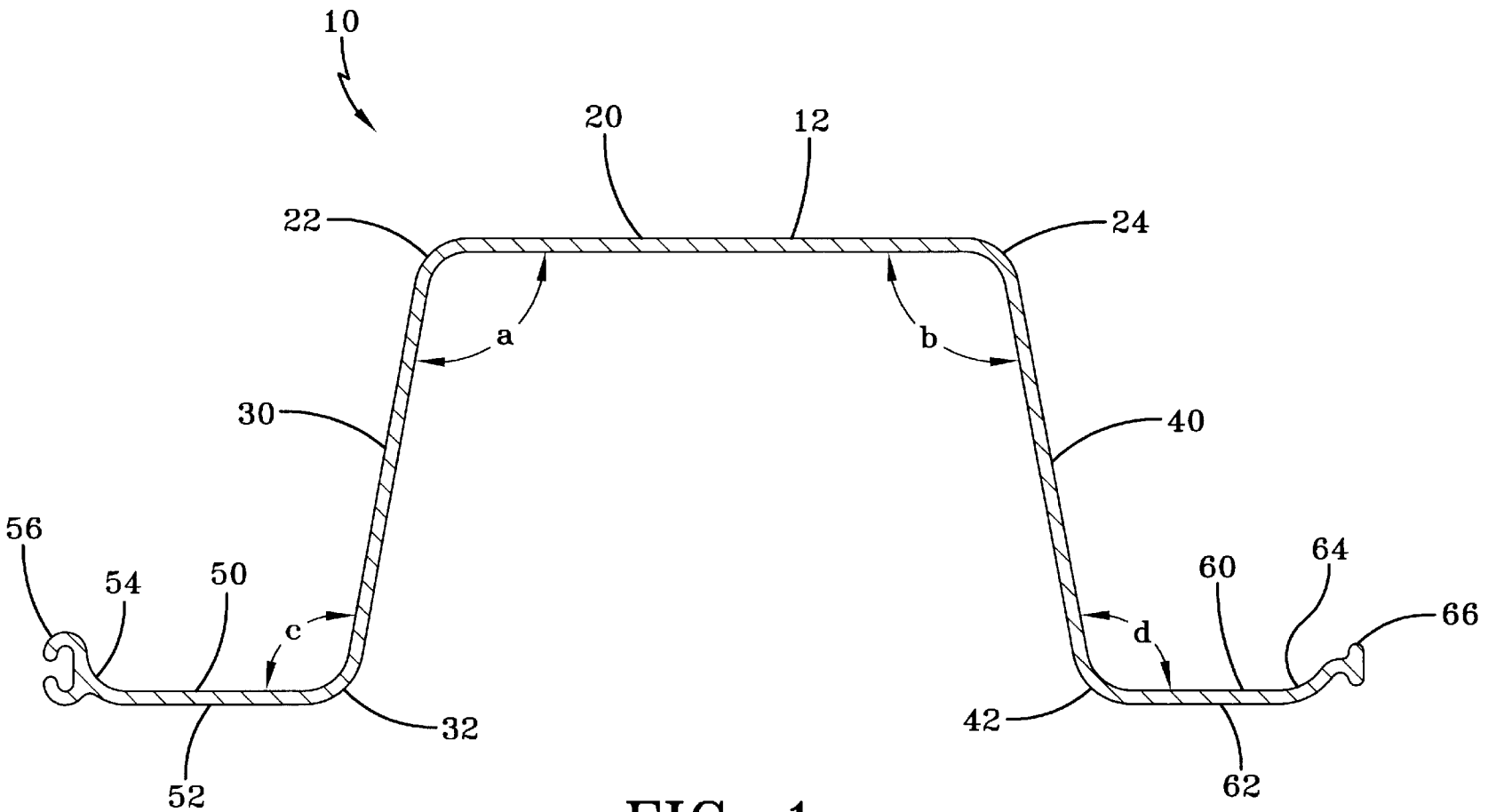
FIG. 1 is a cross sectional view of a preferred embodiment of a retaining panel of the present invention.
Figure 2:
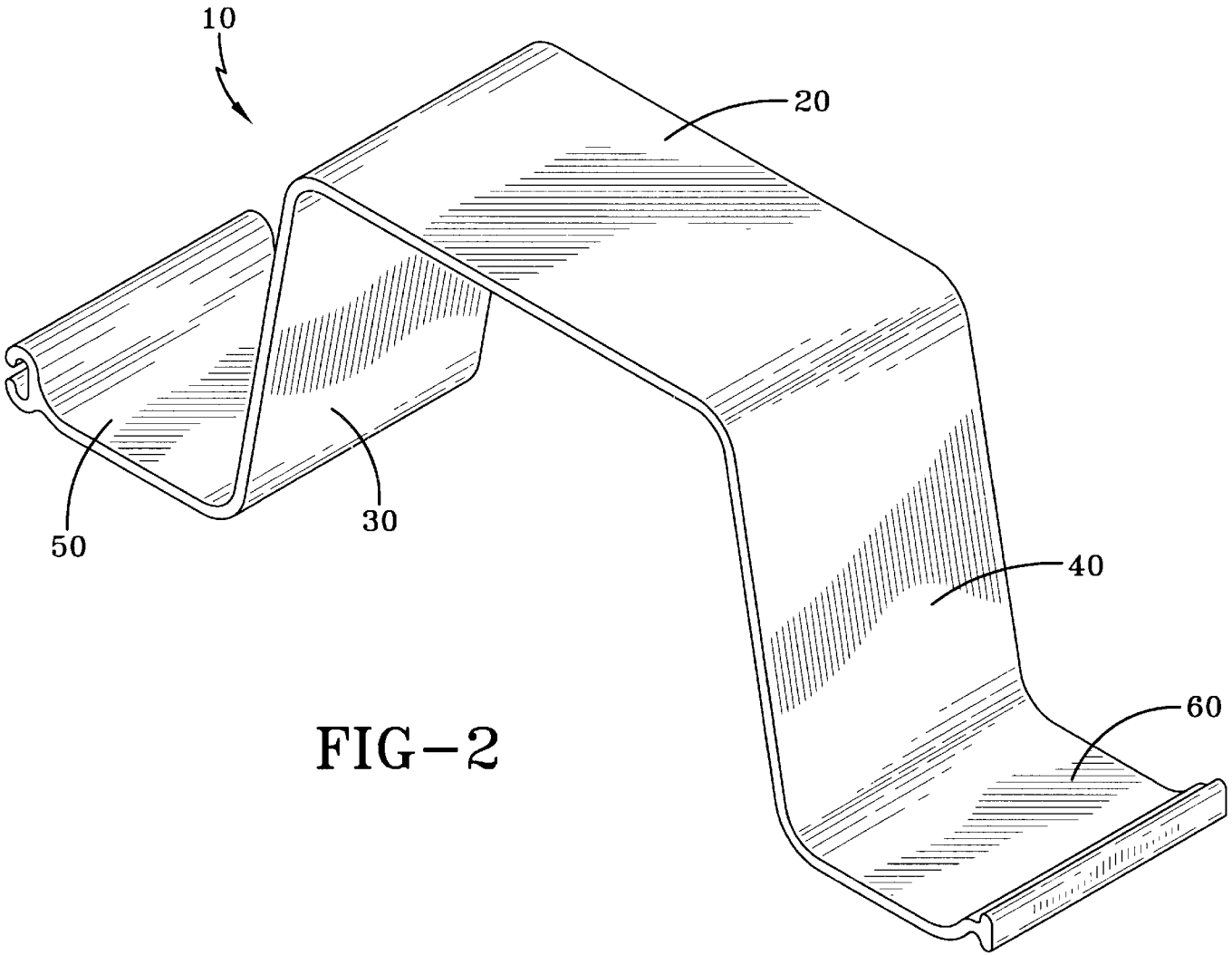
FIG. 2 is a top perspective view of the retaining panel of FIG. 1.
Figure 3:
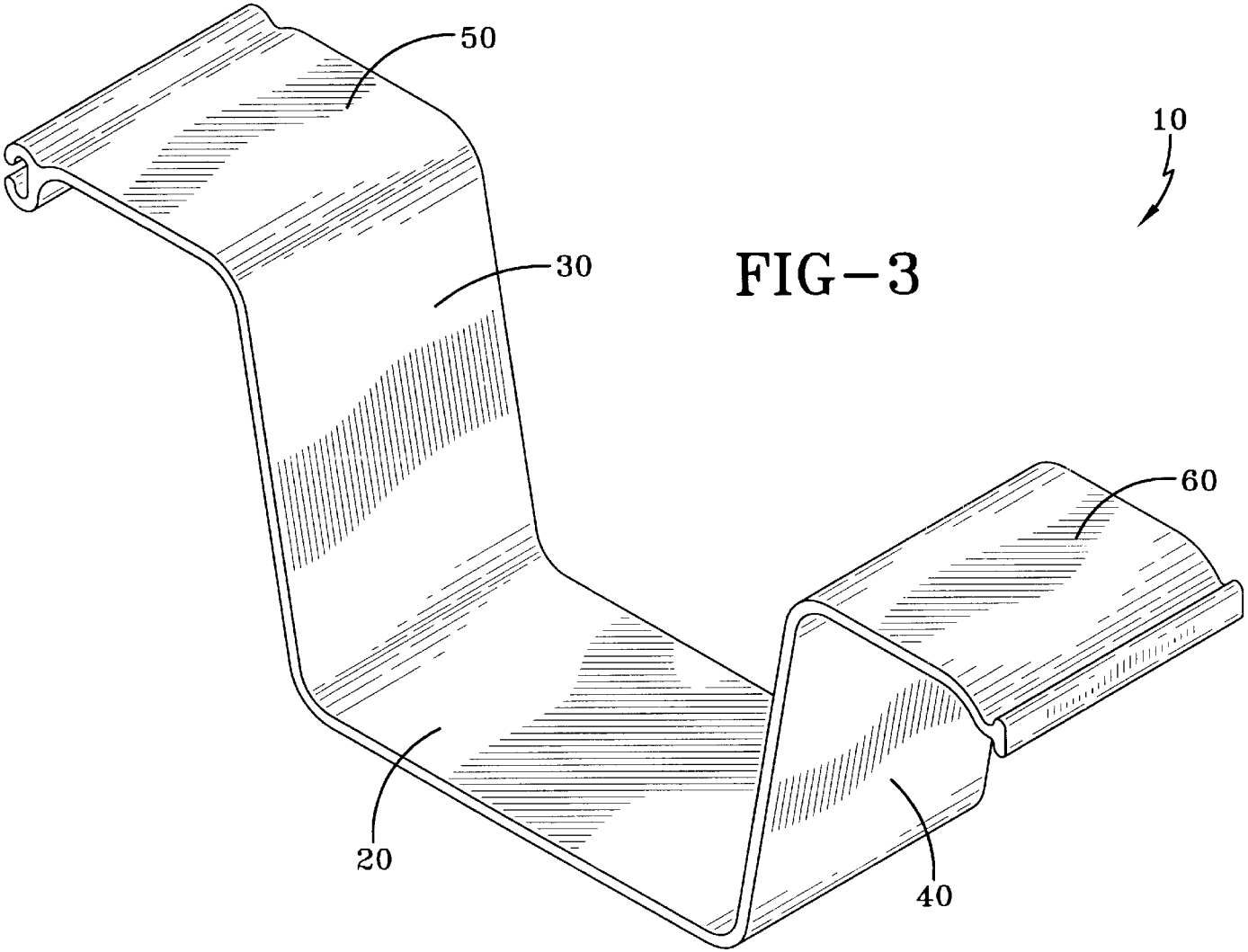
FIG. 3 is a bottom perspective view of the retaining panel of FIG. 1.
Figure 4:
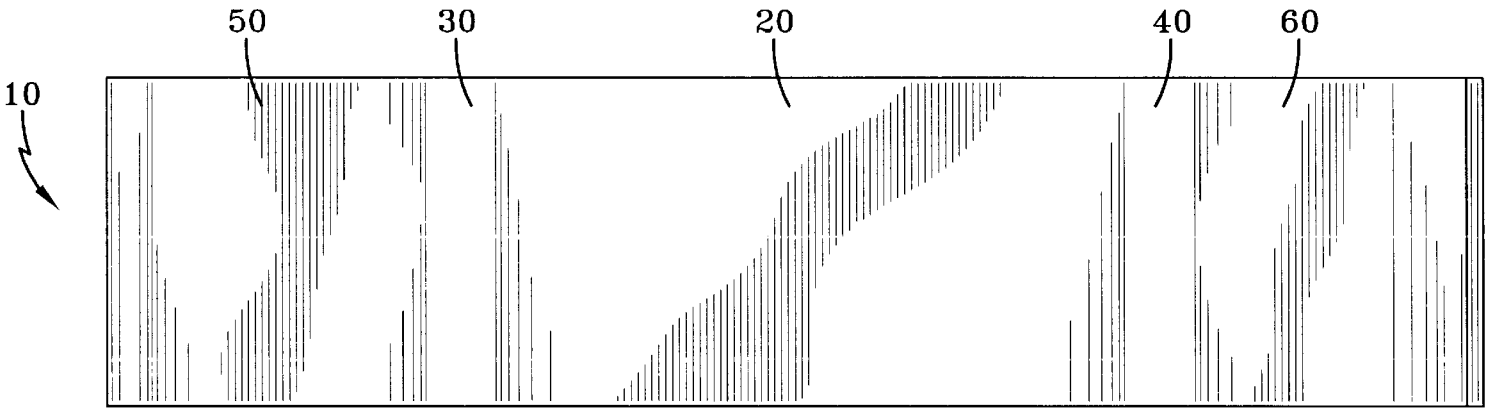
FIG. 4 is a top plan view of the retaining panel of FIG. 1.
Figure 5:
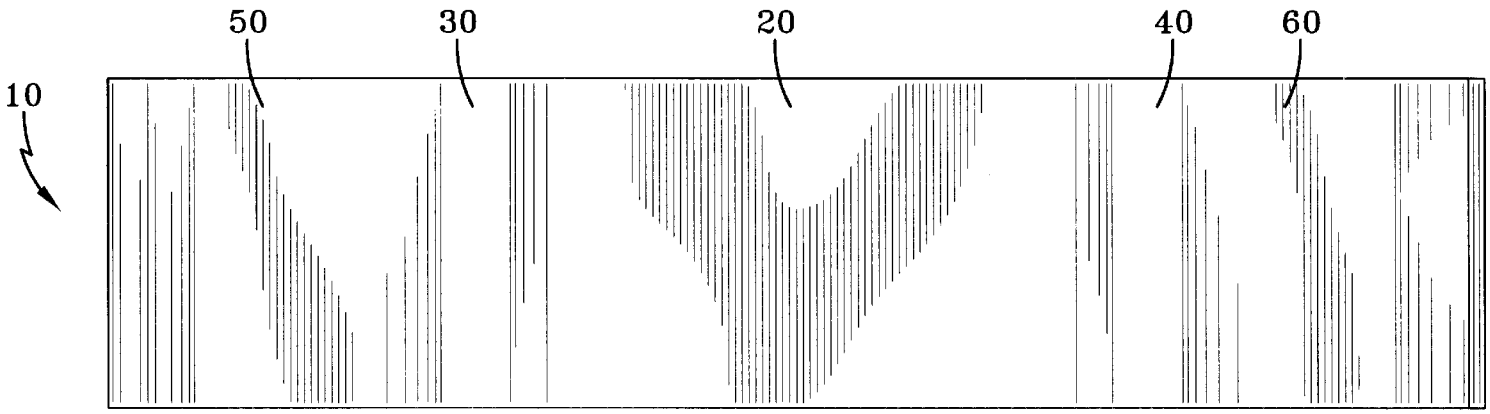
FIG. 5 is a bottom plan view of the retaining panel of FIG. 1.
Figure 6:
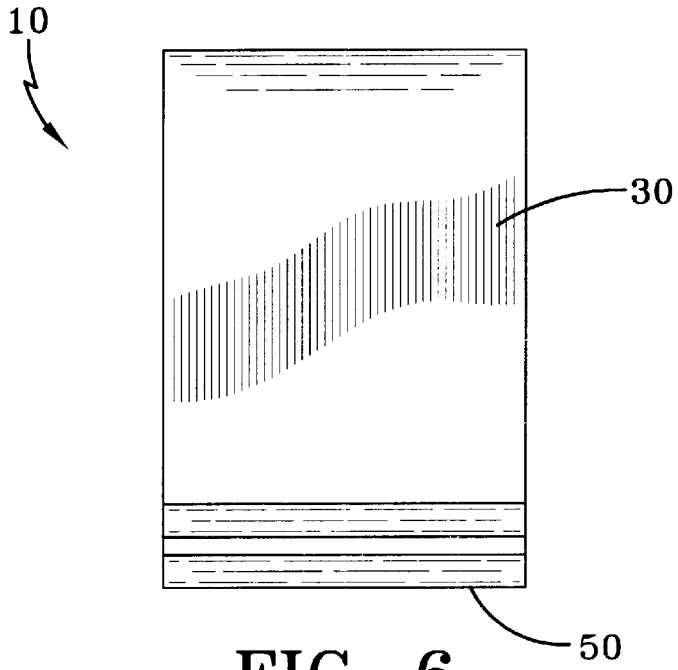
FIG. 6 is a left side elevational view of the retaining panel of FIG. 1.
Figure 7:
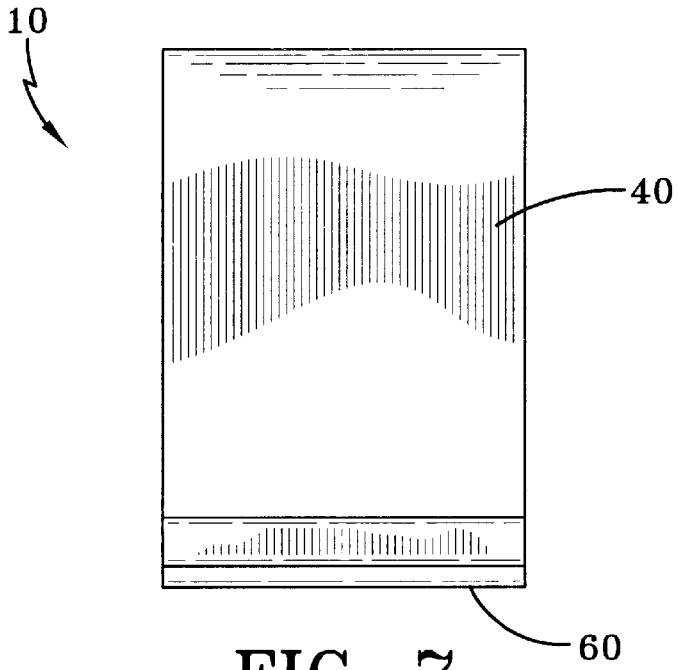
FIG. 7 is a right side elevational view of the retaining panel of FIG. 1.

The present invention is directed to a retaining panel that may protect against a bounding shore with its top preferably extending above ground level and its bottom preferably anchored down into the ground below the water bottom. FIGS. 1 through 7 illustrate a preferred embodiment of a retaining panel of the present invention. The retaining panel 10 includes a central portion 20, a first side portion 30, a second side portion 40, a first flange 50, and a second flange 60. As shown in these figures, the retaining panel 10 is preferably of one-piece construction for maximum durability and longevity. A one-piece construction preferably eliminates unnecessary joints which may eventually fail under the pressures and loads in the field.

The retaining panel has an outer surface 12. The central portion 20 has a first end 22 and a second end 24. The first side portion 30 is integrally connected to and extends at an angle a from the first end 22. Similarly, the second side portion 40 is integrally connected to and extends at an angle b from the second end 24. The length of the first side portion 30 is preferably about equal to the length of the second side portion 40, and the angle a is preferably about equal to the angle b. However, the length of the first side portion 30 may be different than the length of the second side portion 40, the angle a may be different than the angle b. For instance, the aforementioned angles and lengths may vary to enable interconnected retaining panels to conform to the shape of the land.

The first flange 50 is integrally connected to and extends from a rear end 32 of the first side portion 30, and the second flange 60 is integrally connected to and extends from a rear end 42 of the second side portion 40. The first flange 50 extends from the first side portion 30 at an angle c, and the second flange 60 extends from the second side portion 40 at an angle d. The angle c is preferably about equal to the angle d. However, it should be recognized that the angle c may vary from the angle d. For example, the angle c may be different than the angle d so that adjacent retaining panels may be interconnected as will be explained hereinafter.

The first flange 50 has a proximal portion 52 and a distal portion 54. Similarly, the second flange 60 has a proximal portion 62 and a distal portion 64. The distal portion 54 defines a female connecting portion 56, and the distal portion 64 defines a male connecting portion 66. As a result, the retaining panel 10 is preferably adapted to be connected to a substantially similar, adjacent retaining panel by inserting its male connecting portion 66 into the female connecting portion of the adjacent retaining panel. It is further preferred that the female connecting portion 56 and the male connecting portion 66 enable the retaining panel 10 to be interlocked with the retaining panel. Those skilled in the art should recognize that the distal portions 54, 64 may be of various shapes.

Figure 8:
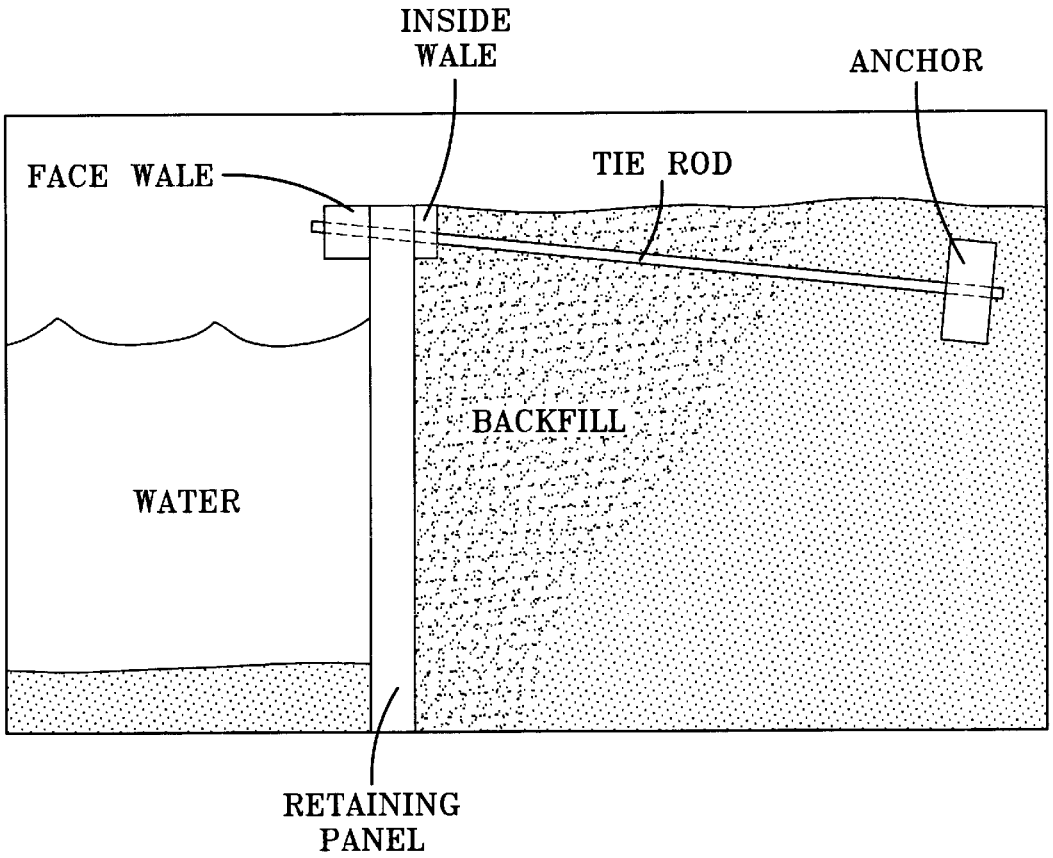
FIG. 8 is a cross sectional view of a preferred embodiment of an installation that may utilize a preferred embodiment of a retaining panel of the present invention.
Figure 9:
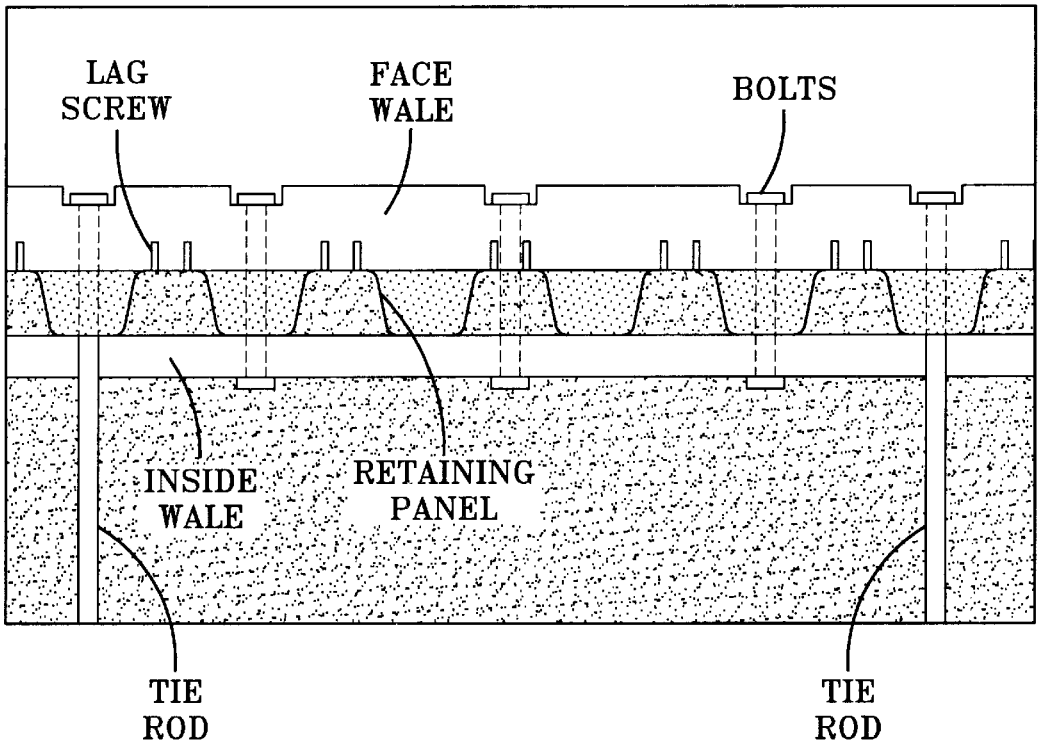
FIG. 9 is another cross sectional view of the installation shown in FIG. 7.

FIGS. 8 and 9 show an example of a barrier installation which may utilize a preferred embodiment of a retaining panel of the present invention. A preferred embodiment of a retaining panel of the present invention may also work with other types of barrier installations. In addition, a preferred embodiment of a retaining panel of the present invention may be interconnected to form other types of wall structures.

EXAMPLE

Figure 10:
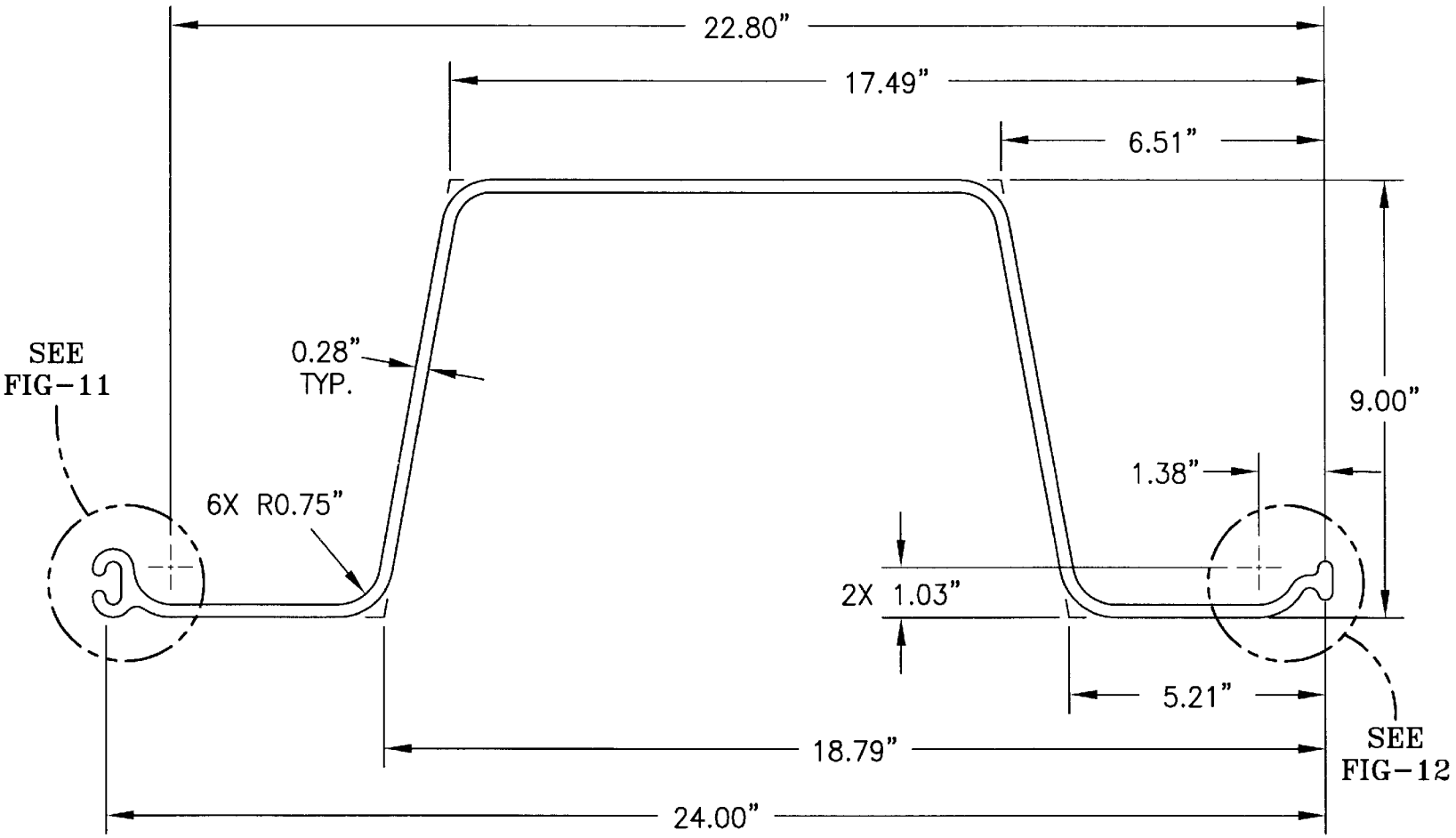
FIG. 10 is a cross sectional view with dimensions of another preferred embodiment of a retaining panel of the present invention.
Figure 11:
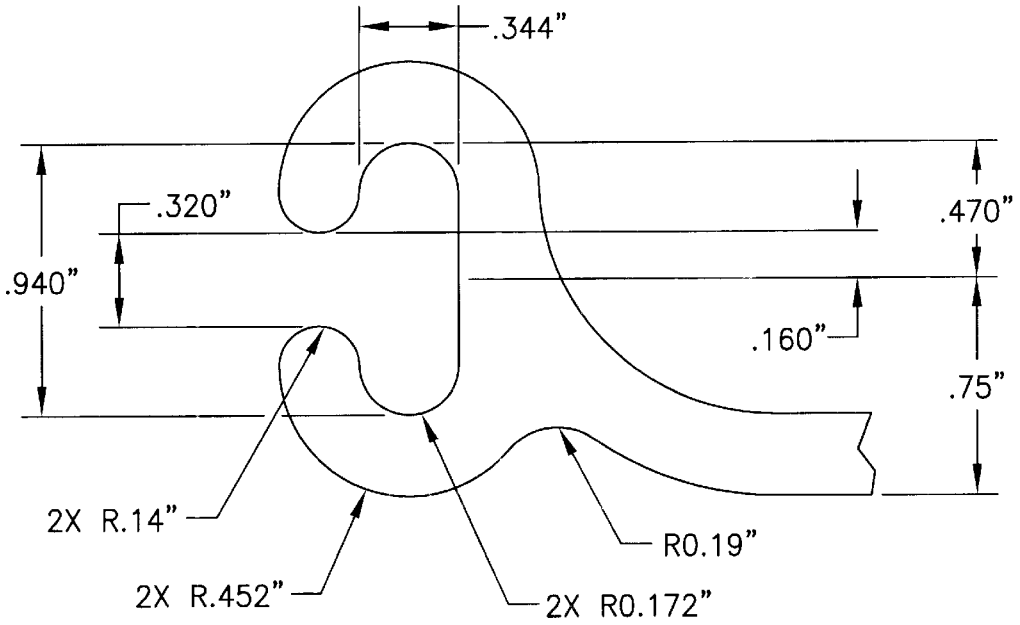
FIG. 11 is a cross sectional view with dimensions of the left distal portion of the retaining panel of FIG. 10.
Figure 12:
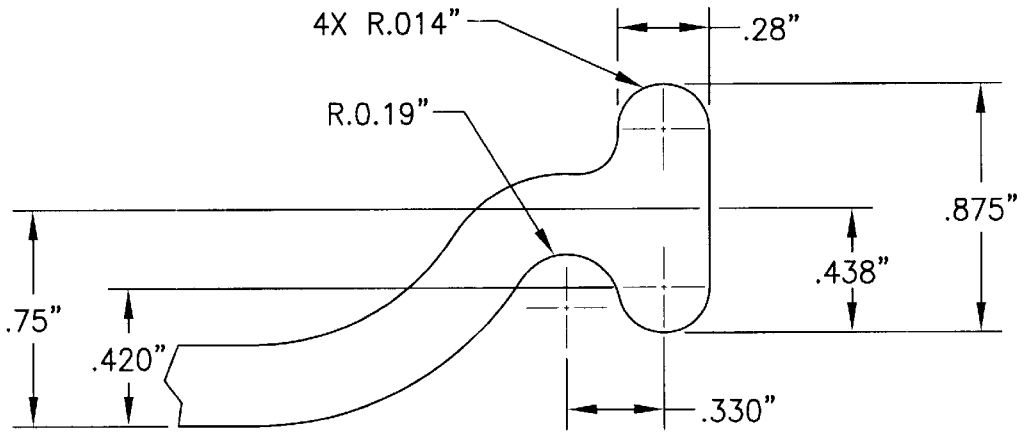
FIG. 12 is a cross sectional view with dimensions of the right distal portion of the retaining panel of FIG. 10.

A retaining panel of the present invention was manufactured using conventional extrusion equipment. The dimensions of the retaining panel are illustrated in FIGS. 10 through 12. The retaining panel was made from a weatherable, impact modified PVC having a minimum cell classification of 1-4013-13-0101 and the following material and mechanical properties:

| | Value |
|---|---|
| Material Properties | |
| Specific Gravity | 1.44 |
| IZOD Impact, ft. lb./in. notch | 15 |
| Tensile Yield Strength | 6,300 |
| Tensile Modulus, psi | 360,000 |
| Flexural Yield Strength, psi | 12,000 |
| Flexural Modulus, psi | 380,000 |
| DTUL @ 264 psi. degrees C. | 72 |
| Mechanical Properties | |
| Coverage Per Sheet (in.) | 24.00 |
| Depth of Cross Section (in.) | 9.00 |
| Wall Thickness (in.) | 0.28 |
| Section Modulus (cu. in./ft.) | 19.70 |
| Allowable Moment (ft. lbs./linear ft.) | 4378 |
| Moment of Inertia | 88.65 |
| Allowable Shear (lb./ft.) | 2433 |

The retaining panel offered the following benefits: (1) consistent physical properties; (2) a desired strength-to-weight ratio; (3) reduces installation time and costs due to increased width as compared to other retaining panels; (4) effective distribution of loads throughout the panel; (5) interlocking at the rear where stress is lower; (6) U-shape design's higher section modulus allows greater spacing between wales to reduce the number required in certain situations; (7) the strength of the U-shape permits cantilevering in some applications; (8) easy to drive and can be driven one at a time as opposed to Z-shaped panels which may require driving two at a time; (9) little or no rotation during installation; (10) interlocks are not readily visible; (11) interlocking design allows inside or outside curves to follow natural contours; and (12) environmentally safe, virtually maintenance free, no need to paint, and impervious to sunlight, saltwater, and marine borers.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A retaining panel for a body of water, the retaining panel comprising:

a continuous central portion having a first end and a second end;

a first side portion integrally connected to and extending rearwardly at a first angle from said first end of said central portion, said first side portion having a rear end;

a second side portion integrally connected to and extending rearwardly at a second angle from said second end of said central portion, said second side portion having a rear end;

a first flange integrally connected to and extending from said rear end of said first side portion, said first flange having a proximal portion and a distal portion, said distal portion of said first flange defining a female connecting portion, said distal portion of said first flange extending forwardly at a third angle from said proximal portion of said first flange to said female connecting portion; and a second flange integrally connected to and extending from said rear end of said second side portion, said second flange having a proximal portion and a distal portion, said distal portion of said second flange defining a male connecting portion, said distal portion of said second flange extending forwardly at a fourth angle from said proximal portion of said second flange and terminating with said male connecting portion;

wherein said retaining panel has a width of at least about 24 inches and is adapted to be connected to a substantially similar, adjacent retaining panel by inserting said male connecting portion of said retaining panel into said female connecting portion of said adjacent retaining panel.

2. The retaining panel of claim 1 wherein said retaining panel is adapted to be interlocked with said adjacent retaining panel by inserting said male connecting portion of said retaining panel into said female connecting portion of said adjacent retaining panel.

3. The retaining panel of claim 1 wherein said retaining panel is of substantially uniform thickness.

4. The retaining panel of claim 1 wherein an intermediate portion of said central portion has a substantially level outer surface approximately between said first end and said second end.

5. The retaining panel of claim 1 wherein an intermediate portion of said first side portion has a substantially level outer surface approximately between said first end of said central portion and said rear end of said first side portion.

6. The retaining panel of claim 1 wherein an intermediate portion of said second side portion has a substantially level outer surface approximately between said second end of said central portion and said rear end of said second side portion.

7. The retaining panel of claim 1 wherein said proximal portion of said first flange has a substantially level outer surface approximately between said rear end of said first side portion and said distal portion of said first flange.

8. The retaining panel of claim 1 wherein said proximal portion of said second flange has a substantially level outer surface approximately between said rear end of said second side portion and said distal portion of said second flange.

9. The retaining panel of claim 1 wherein said first angle is approximately equal to said second angle.

10. The retaining panel of claim 1 wherein the length of said first side portion is approximately equal to the length of said second side portion.

11. The retaining panel of claim 10 wherein said central portion is approximately parallel to said proximal portions of said first flange and said second flange.

12. The retaining panel of claim 1 wherein said central portion is approximately parallel to said proximal portions of said first flange and said second flange.

13. The retaining panel of claim 1 wherein said retaining panel is comprised of polyvinyl chloride.

14. The retaining panel of claim 1 wherein:

said female connecting portion is substantially C-shaped;

said male connecting portion is substantially T-shaped; and said distal portion of said second flange levels to being substantially parallel to said proximal portion of said second flange prior to terminating with said male connecting portion.

15. A retaining panel for a body of water, said retaining panel comprising:

a continuous central portion having a first end and a second end;

a first side portion integrally connected to and extending at a first angle from said first end of said central portion, said first side portion having a rear end;

a second side portion integrally connected to and extending at a second angle from said second end of said central portion, said second angle approximately equal to said first angle, said second side portion having a rear end;

a first flange integrally connected to and extending at a third angle from said rear end of said first side portion, said first flange having a proximal portion and a distal portion, said distal portion of said first flange defining a female connecting portion, said distal portion of said first flange extending at a fifth angle from said proximal portion of said first flange to said female connecting portion; and a second flange integrally connected to and extending at a fourth angle from said rear end of said second side portion, said second flange having a proximal portion and a distal portion, said distal portion of said second flange defining a male connecting portion, said distal portion of said second flange extending at a sixth angle from said proximal portion of said second flange and terminating with said male connecting portion;

wherein said retaining panel has a width of at least about 24 inches and is adapted to be connected to a substantially similar, adjacent retaining panel by inserting said male connecting portion of said retaining panel into said female connecting portion of said adjacent retaining panel.

16. The retaining panel of claim 15 wherein said retaining panel is adapted to be interlocked with said adjacent retaining panel by inserting said male connecting portion of said retaining panel into said female connecting portion of said adjacent retaining panel.

17. The retaining panel of claim 15 wherein said third angle is approximately equal to said fourth angle.

18. The retaining panel of claim 15 wherein the length of said first side portion is approximately equal to the length of said second side portion.

19. The retaining panel of claim 15 wherein said retaining panel is comprised of polyvinyl chloride.

20. The retaining panel of claim 15 wherein:

said female connecting portion is substantially C-shaped;

said male connecting portion is substantially T-shaped; and said distal portion of said second flange levels to being substantially parallel to said proximal portion of said second flange prior to terminating with said male connecting portion.

21. A retaining panel of one-piece construction for a body of water, said retaining panel comprising:

a central portion having a first end and a second end;

a first side portion integrally connected to and extending at a first angle from said first end of said central portion, said first side portion having a rear end;

a second side portion integrally connected to and extending at a second angle from said second end of said central portion, said second side portion having a rear end, said second angle approximately equal to said first angle, the length of said second side portion approximately equal to the length of said first side portion;

a first flange integrally connected to and extending at a third angle from said rear end of said first side portion, said first flange having a proximal portion and a distal portion, said distal portion of said first flange defining a female connecting portion, said distal portion of said first flange extending at a fifth angle from said proximal portion of said first flange to said female connecting portion; and a second flange integrally connected to and extending at a fourth angle from said rear end of said second side portion, said fourth angle approximately equal to said third angle, said second flange having a proximal portion and a distal portion, said distal portion of said second flange defining a male connecting portion, said distal portion of said second flange extending at a sixth angle from said proximal portion of said second flange and terminating with said male connecting portion;

wherein said retaining panel has a width of at least about 24 inches and is adapted to be interlocked with a substantially similar, adjacent retaining panel by inserting said male connecting portion of said retaining panel into said female connecting portion of said adjacent retaining panel.

22. The retaining panel of claim 21 wherein said retaining panel is comprised of polyvinyl chloride.

23. The retaining panel of claim 21 wherein:

said female connecting portion is substantially C-shaped;

said male connecting portion is substantially T-shaped; and said distal portion of said second flange levels to being substantially parallel to said proximal portion of said second flange prior to terminating with said male connecting portion.

* * * * *

US006575667C1

(12) EX PARTE REEXAMINATION CERTIFICATE (6384th)

United States Patent

Burt et al.

(10) Number: US 6,575,667 C1

(45) Certificate Issued: Aug. 19, 2008

(54) SEAWALL PANEL

(75) Inventors: Kevin T. Burt, Columbus, OH (US); Miguel Terc, Atlanta, GA (US)

(73) Assignee: CMI Limited Co., Atlanta, GA (US)

Reexamination Request:
No. 90/008,511, Mar. 21, 2007

Reexamination Certificate for:

| | |
|---|---|
| Patent No.: | **6,575,667** |
| Issued: | **Jun. 10, 2003** |
| Appl. No.: | **09/199,933** |
| Filed: | **Nov. 25, 1998** |

Related U.S. Application Data

(60) Provisional application No. 60/066,588, filed on Nov. 26, 1997.

(51) Int. Cl.
*E02D 5/08* (2006.01)

(52) U.S. Cl. ..... 405/287; 405/274; 405/284

(58) Field of Classification Search ..... None
See application file for complete search history.

(56) References Cited

U.S. PATENT DOCUMENTS 5,145,287 A 9/1992 Hooper et al.
5,333,971 A 8/1994 Lewis

OTHER PUBLICATIONS

R.A.W. Corporation, "Retaining Walls, New Fiberglass Technology for Marine and Land Erosion Control," 1987, 4 pages.

International Grating, Inc., "LandLok FRP Composite Sheet Pile for Marine Blukheads," 1994, 4 pages.

*Primary Examiner*—Jeffrey R. Jastrzab

(57) ABSTRACT

The present invention is directed to a retaining panel of one-piece construction for a body of water. A preferred embodiment of the retaining panel comprises a central portion, two side portions, and two flanges. The central portion has a first end and a second end. One side portion is integrally connected to and extends at a first angle from the first end of the central portion. Similarly, the other side portion is integrally connected to and extends at a second angle from the second end of the central portion. It is preferred that the first angle and the second angle are approximately equal. It is further preferred that the lengths of the first and second side portions are approximately equal. One flange is integrally connected to and extends at a third angle from a rear end of one side portion, and the other flange is integrally connected to and extends at a fourth angle from a rear end of the other side portion. It is preferred that the third and fourth angles are approximately equal. Each of the flanges has a proximal portion and a distal portion. The distal portion of one of the flanges defines a female connecting portion, and the distal portion of the other flange defines a male connecting portion. The retaining panel is preferably adapted to be interlocked with a substantially similar, adjacent retaining panel by inserting its male connecting portion into the female connecting portion of the adjacent retaining panel.

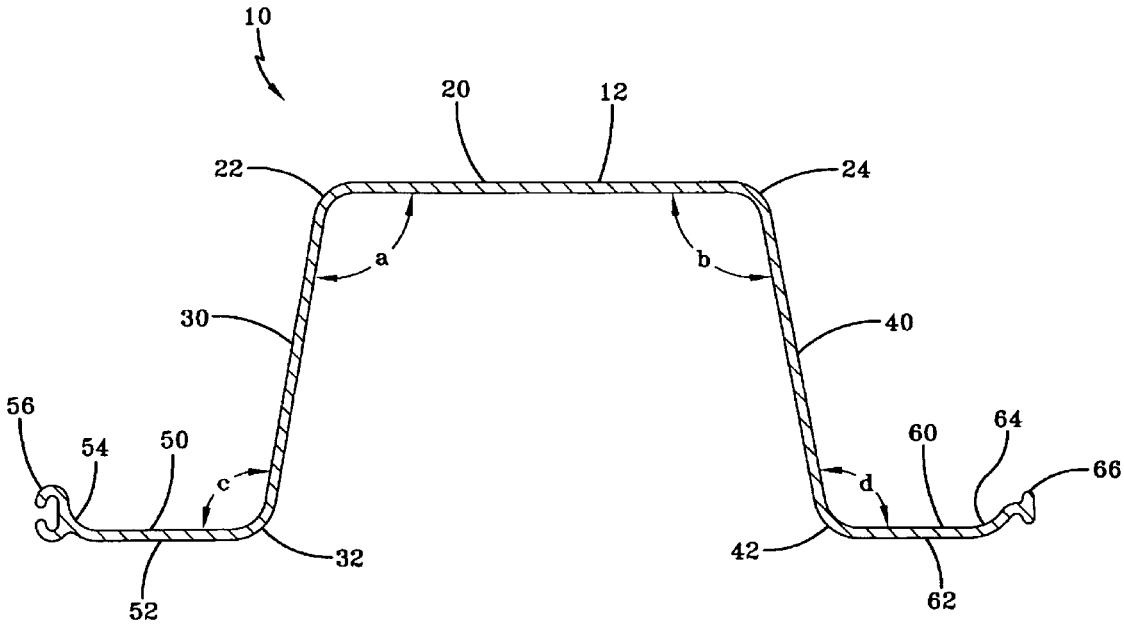

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 60 to column 4, line 6:

The first flange 50 has a proximal portion 52 and a distal portion 54. Similarly, the second flange 60 has a proximal portion 62 and a distal portion 64. The distal portion 54 defines a female connecting portion 56, and the distal portion 64 defines a male connecting portion 66. As a result, the retaining panel 10 is preferably adapted to be connected to a substantially similar, adjacent retaining panel by inserting its male connecting portion 66 into the female connecting portion of the adjacent retaining panel. It is further preferred that the female connecting portion 56 and the male connecting portion 66 enable the retaining panel 10 to be interlocked with the *adjacent* retaining [panel] *panels*. Those skilled in the art should recognize that the distal portions 54, 64 may be of various shapes.

AS A RESULT OF REEXAMINATION, IT HAS BEEN DETERMINED THAT:

Claims 1–3, 15, 16, 19 and 20–22 are determined to be patentable as amended.

Claims 4–14, 17, 18 and 23, dependent on an amended claim, are determined to be patentable.

1. A retaining panel for a body of water, the retaining panel *formed in one piece and consisting essentially of plastic construction, said retaining panel* comprising:

a continuous central portion having a first end and a second end;

a first side portion integrally connected to and extending rearwardly at a first angle from said first end of said central portion, said first side portion having a rear end;

a second side portion integrally connected to and extending rearwardly at a second angle from said second end of said central portion, said second side portion having a rear end;

a first flange integrally connected to and extending from said rear end of said first side portion, said first flange having a proximal portion and a distal portion, said distal portion of said first flange defining a female connecting portion, said distal portion of said first flange extending forwardly at a third angle from said proximal portion of said first flange to said female connecting portion; [and]

a second flange integrally connected to and extending from said rear end of said second side portion, said second flange having a proximal portion and a distal portion, said distal portion of said second flange defining a male connecting portion, said distal portion of said second flange extending forwardly at a fourth angle from said proximal portion of said second flange and terminating with said male connecting portion;

*said male connecting portion being elongated with a length greater than its width and said length substantially perpendicular to the plane of said central portion and having opposed ends and connected intermediate its opposed ends to said proximal portion of said second flange with said opposed ends extending beyond said proximal portion of said second flange; and*

*said female connecting portion defining a C-shaped opening corresponding to the size and shape of said elongated male connecting portion for receiving and surrounding said opposed ends of said male connecting portion of an adjacent substantially similar retaining panel;* wherein said retaining panel has a width of at least about 24 inches and is adapted to be connected to a substantially similar, adjacent retaining panel by inserting said male connecting portion of said retaining panel into said female connecting portion of said adjacent retaining panel.

2. The retaining panel of claim 1 wherein said retaining panel *is formed of substantially uniform thickness, said male connecting portion being of substantially the same thickness as the remaining portions of the retaining panel, and said retaining panel* is adapted to be interlocked with said adjacent retaining panel by inserting said male connecting portion of said retaining panel into said female connecting portion of said adjacent retaining panel.

3. The retaining panel of claim 1 wherein said retaining panel is of substantially uniform thickness*, with said male connecting portion and said female connecting portion being of substantially the same thickness as the remaining portions of the retaining panel.*

15. A retaining panel for a body of water, said retaining panel comprising:

a continuous central portion having a first end and a second end;

a first side portion integrally connected to and extending at a first angle from said first end of said central portion, said first side portion having a rear end;

a second side portion integrally connected to and extending at a second angle from said second end of said central portion, said second angle approximately equal to said first angle, said second side portion having a rear end;

a first flange integrally connected to and extending at a third angle from said rear end of said first side portion, said first flange having a proximal portion and a distal portion, said distal portion of said first flange defining a female connecting portion, said distal portion of said first flange extending at a fifth angle from said proximal portion of said first flange to said female connecting portion; and a second flange integrally connected to and extending at a fourth angle from said rear end of said second side portion, said second flange having a proximal portion and a distal portion, said distal portion of said second flange defining a male connecting portion, said distal portion of said second flange extending at a sixth angle from said proximal portion of said second flange and terminating with said male connecting portion;

wherein said retaining panel *consists essentially of plastic construction, is of substantially uniform thickness,* has a width of at least about 24 inches and is adapted to be connected to a substantially similar, adjacent retaining panel by inserting said male connecting portion of said retaining panel into said female connecting portion of said adjacent retaining panel.

16. The retaining panel of claim 15 wherein said retaining panel is adapted to be interlocked with said adjacent retaining panel by inserting said male connecting portion of said retaining panel into said female connecting portion of said adjacent retaining panel, *said male connecting portion being elongated with a length oriented substantially perpendicular to said second flange and having opposed ends; and*

*said female connecting portion defining a C-shaped opening corresponding to the size and shape of said elongated male connecting portion for receiving and surrounding said opposed ends of a male connecting portion of an adjacent duplicate retaining panel.*

19. The retaining panel of claim 15 wherein said retaining panel [is comprised] *consists essentially* of polyvinyl chloride.

20. [The] *A* retaining panel [of claim 15 wherein:] *for a body of water, said retaining panel comprising:*

*a continuous central portion having a first end and a second end;*

*a first side portion integrally connected to and extending at a first angle from said first end of said central portion, said first side portion having a rear end;*

*a second side portion integrally connected to and extending at a second angle from said second end of said central portion, said second angle approximately equal to said first angle, said second side portion having a rear end;*

*a first flange integrally connected to and extending at a third angle from said rear end of said first side portion, said first flange having a proximal portion and a distal portion, said distal portion of said first flange defining a female connecting portion,* said female connecting portion is substantially C-shaped;

*said distal portion of said first flange extending at a fifth angle from said proximal portion of said first flange to said female connecting portion; and*

*a second flange integrally connected to and extending at a fourth angle from said rear end of said second side portion, said second flange having a proximal portion and a distal portion, said distal portion of said second flange defining a male connecting portion,* said male connecting portion is substantially T-shaped, *said distal portion of said second flange extending at a sixth angle from said proximal portion of said second flange and terminating with said male connecting portion;* and said distal portion of said second flange levels to being substantially parallel to said proximal portion of said second flange prior to terminating with said male connecting portion,

*wherein said retaining panel consists essentially of plastic and is characterized by having been formed by extrusion and has a width of at least about 24 inches and is adapted to be connected to a substantially similar, adjacent retaining panel by inserting said male connecting portion of said retaining panel into said female connecting portion of said adjacent retaining panel.*

21. A retaining panel of one-piece construction, *consisting essentially of plastic,* for a body of water, said retaining panel comprising:

a central portion having a first end and a second end;

a first side portion integrally connected to and extending at a first angle from said first end of said central portion, said first side portion having a rear end;

a second side portion integrally connected to and extending at a second angle from said second end of said central portion, said second side portion having a rear end, said second angle approximately equal to said first angle, the length of said second side portion approximately equal to the length of said first side portion;

a first flange integrally connected to and extending at a third angle from said rear end of said first side portion, said first flange having a proximal portion and a distal portion, said distal portion of said first flange defining a female connecting portion, said distal portion of said first flange extending at a fifth angle from said proximal portion of said first flange to said female connecting portion; and a second flange integrally connected to and extending at a fourth angle from said rear end of said second side portion, said fourth angle approximately equal to said third angle, said second flange having a proximal portion and a distal portion, said distal portion of said second flange defining a male connecting portion, said distal portion of said second flange extending at a sixth angle from said proximal portion of said second flange and terminating with said male connecting portion;

wherein said retaining panel has a width of at least about 24 inches and is adapted to be interlocked with a substantially similar, adjacent retaining panel by inserting said male connecting portion of said retaining panel into said female connecting portion of said adjacent retaining panel.

22. The retaining panel of claim 21 wherein said retaining panel [is comprised] *consists essentially* of polyvinyl chloride.

* * * * *